US005365722A

United States Patent [19]

Edwards et al.

[11] Patent Number: 5,365,722

[45] Date of Patent: Nov. 22, 1994

[54] METHOD AND APPARATUS FOR FILLING A CONTAINER WITH A FLUID

[75] Inventors: Kenneth N. Edwards, Glendale; Micheal C. Lapp, Sr., La Mirada, both of Calif.

[73] Assignee: Dunn-Edwards Corp., Los Angeles, Calif.

[21] Appl. No.: 27,275

[22] Filed: Mar. 5, 1993

[51] Int. Cl.[5] ..... B65B 3/24; B65B 3/28

[52] U.S. Cl. ..... 53/502; 53/237; 53/475; 53/503

[58] Field of Search ..... 53/503, 502, 501, 237, 53/240, 475, 473, 471; 141/156, DIG. 2

[56] References Cited

U.S. PATENT DOCUMENTS

| | | | |
|---|---|---|---|
| 2,548,222 | 4/1951 | Kindseth | 53/237 X |
| 3,831,821 | 8/1974 | Doyen | 53/503 X |
| 3,977,483 | 8/1976 | Greanias | 53/502 X |
| 4,074,507 | 2/1978 | Ruf et al. | 53/502 |
| 5,038,548 | 8/1991 | Sieg | 53/237 X |
| 5,083,591 | 1/1992 | Edwards et al. | 141/9 |
| 5,116,134 | 5/1992 | Edwards et al. | 366/208 |
| 5,159,959 | 11/1992 | Bohm | 53/503 X |
| 5,230,203 | 7/1993 | Wu et al. | 53/503 X |

*Primary Examiner*—James F. Coan
*Attorney, Agent, or Firm*—Stetina Brunda & Buyan

[57] ABSTRACT

An apparatus for filling a container with a fluid comprising a fluid supply source having a pump fluidly coupled thereto and electrically interfaced to a controller. Fluidly coupled to the pump is a nozzle valve which is also electrically interfaced to the controller. During the operation of the apparatus, the container is positioned under the nozzle valve, with the controller being operable to fill the container with the first volume of the fluid from the supply source at a first flow rate, and fill the container with the second volume of the fluid at a second flow rate which is lower than the first flow rate.

14 Claims, 2 Drawing Sheets

METHOD AND APPARATUS FOR FILLING A CONTAINER WITH A FLUID

FIELD OF THE INVENTION

The present invention relates generally to devices for filling containers with fluids, and more particularly to an apparatus for sequentially filling a container with first and second volumes of paint at first and second flow rates which are adapted to achieve a high level of accuracy in the volume of paint dispensed into the container.

BACKGROUND OF THE INVENTION

In the prior art, many devices have been developed for filling containers with desired fluids. One of the greatest obstacles encountered in designing such devices pertains to maintaining a high level of accuracy in the volume of fluid dispensed into the container. Such volume control usually necessitates taking weight measurements of the container prior to, during and subsequent to the filling thereof with the fluid, and/or measuring the flow rate of the fluid as it is being dispensed into the container.

The problems typically associated with achieving a high accuracy level in the volume of fluid dispensed into the container are magnified when precise volume control is desired for viscus, quickly curing fluids such as paints. In most prior art paint dispensing devices, residual quantities of paint remain within the pumps, dispensing nozzles, flow lines and other components of the device when the device is deactivated. While the device is inactive, this residual paint typically dries, thus resulting in an accumulation of dried paint in the aforementioned components which steadily increases over time. Due to this increasing accumulation, the precise volume of the paint dispensed into the container is slightly altered with every fill cycle of the device. The present invention overcomes these and other problems associated with prior art paint dispensing devices by providing an apparatus which is adapted to fill a container with a precise volume of paint and continuously maintain a high accuracy level in the volume of paint dispensed into the container.

SUMMARY OF THE INVENTION

In accordance with a preferred embodiment of the present invention there is provided an apparatus for filling a container with a fluid, such as paint, comprising a means for filling the container with a first volume of fluid at a first flow rate and a means for filling the container with a second volume of fluid at a second flow rate which is lower than the first flow rate. The apparatus further includes means for controlling and coordinating the operation of the first and second volume filling means. In the preferred embodiment, the first and second volume filling means include a fluid supply source and a pump which is fluidly coupled to the supply source and electrically interfaced to the control means. Also provided is a nozzle valve which is fluidly coupled to the pump and electrically interfaced to the control means. During operation of the apparatus, the container is positioned under the nozzle valve.

The first volume filling means further includes an incremental encoder which is electrically interfaced to the pump and control means and operable to count the rotations of the pump impeller. During a fill cycle, the control means is programed to sequentially activate the pump and open the nozzle valve to allow the fluid to be pumped from the supply source into the container at the first flow rate, and deactivate the pump and close the nozzle valve in response to an electrical signal generated by the encoder corresponding to a preselected number of impeller rotations programmed into the control means needed to establish that the container has been filled with the first volume.

The second volume filling means further includes a scale which is electrically interfaced to the control means, and oriented under the nozzle valve such that the container is positioned thereon during the fill cycle. The control means is further programmed to take a first measurement of the container tare weight via the scale prior to filling the container with the first volume of fluid and store the first weight measurement. Subsequent to filling the container with the first volume, the control means activates the pump and opens the nozzle valve to allow the second volume of fluid to be pumped into the container at the second flow rate. As the container is being filled with the second volume, the control means takes total weight measurements of the container and compares these measurements to a desired target fill weight. The control means then deactivates the pump and closes the nozzle valve when a total weight measurement is obtained corresponding to a target fill weight measurement stored in the control means establishing that the container has been filled with the second volume.

The apparatus constructed in accordance with the present invention further comprises a conveyor upon which the container is positioned. Means are also provided for sealing a lid member to the container and for incrementally moving the container along the conveyor. In this respect, the moving means is operable to transport the container from the first and second volume filling means to the lid member sealing means. The conveyor further includes a measurement section which is interfaced to the scale in a manner wherein the scale is able to take various weight measurements of the container when such is positioned on the measurement section by the moving means.

In the preferred embodiment, the moving means itself comprises first and second roller members which are disposed at opposed ends of the conveyor, with at least one of the roller members being mechanically coupled to a drive means electrically interfaced to the control means. The moving means further comprises first and second continuous belt members which extend about the first and second roller members in a manner wherein the first and second belt members extend longitudinally along opposed sides of the conveyor. Attached to and extending laterally between the first and second belt members in spaced relation are a plurality of elongate pusher rods which are operable to incrementally move the container along the conveyor. Advantageously, the control means is programmed to cause the pusher rods to back away out of abutting contact with the containers after each incremental movement so as not to affect the weight measurements taken by the scale in relation to the particular container positioned upon the measurement section and under the nozzle valve.

Further in accordance with the present invention, there is provided a method for filling a container with a desired fluid which includes the steps of measuring and storing the tare weight of the container via a scale upon which the container is positioned, and filling the container with first and second volumes of fluid at first and second flow rates, respectively. The step of filling the container with the first volume further comprises the steps of counting the number of rotations of a pump impeller via an incremental encoder and deactivating the pump in response to an electrical signal generated by the encoder corresponding to a preselected number of impeller rotations programmed in a control means needed to establish that the container has been filled with the first volume. The step of filling the container with the second volume comprises the steps of taking measurements of the total weight of the container via the scale as it is being filled with the second volume, comparing each total weight measurement to a target fill weight stored in the control means and deactivating the pump when a total weight measurement is obtained which falls within an acceptable range corresponding to the target fill weight, thus establishing that the container has been filled with the second volume.

The present method further includes a first and second volume filling operation calibration procedure which, in the preferred embodiment, comprises a two-stage process. In the initial stage, a target fill weight is calculated by adding the tare weight of the container to a predetermined value corresponding to the total weight of the fluid to be dispensed into the container to totally fill the same. A first total weight measurement of the container is then taken after it is filled with a first preselected volume at a first flow rate. The ratio of the number of impeller rotations which occurred during the first preselected volume filling operation to the first total weight measurement is then calculated, as is the number of impeller rotations needed to dispense a second preselected volume of fluid into the container at a second flow rate lower than the first flow rate. After the container has been filled with the second preselected volume of fluid, a second total weight measurement of the container is taken, which is followed by the dispensation of a third preselected volume of fluid into the container at a third flow rate which is lower than the second flow rate. The third volume filling operation is terminated when the total weight of the container reaches the target fill weight, with the low speed calibration data then being calculated.

In the second stage of the calibration process, a new target fill weight is calculated by adding the tare weight of a second container to the previously entered total fluid weight value. After the container is filled with a new first preselected volume of paint, and a new first total weight measurement is taken, the ratio of the number of impeller rotations which occurred during the new first preselected volume filling operation to the new first total weight measurement is calculated, with the ratio being stored in the control means to be used as a base setting for the required number of impeller rotations needed to conduct the first volume filling operation. A new second preselected volume of fluid is then dispensed into the container at the third flow rate, with such filling operation being terminated when the total weight of the container reaches the new target fill weight. Thereafter, the low speed fill parameters are calculated and are subsequently stored in the control means.

BRIEF DESCRIPTION OF THE DRAWINGS

These as well as other features of the present invention will become more apparent upon reference to the drawings wherein.

DETAILED DESCRIPTION OF THE PREFERRED EMBODIMENT

Figure 1:
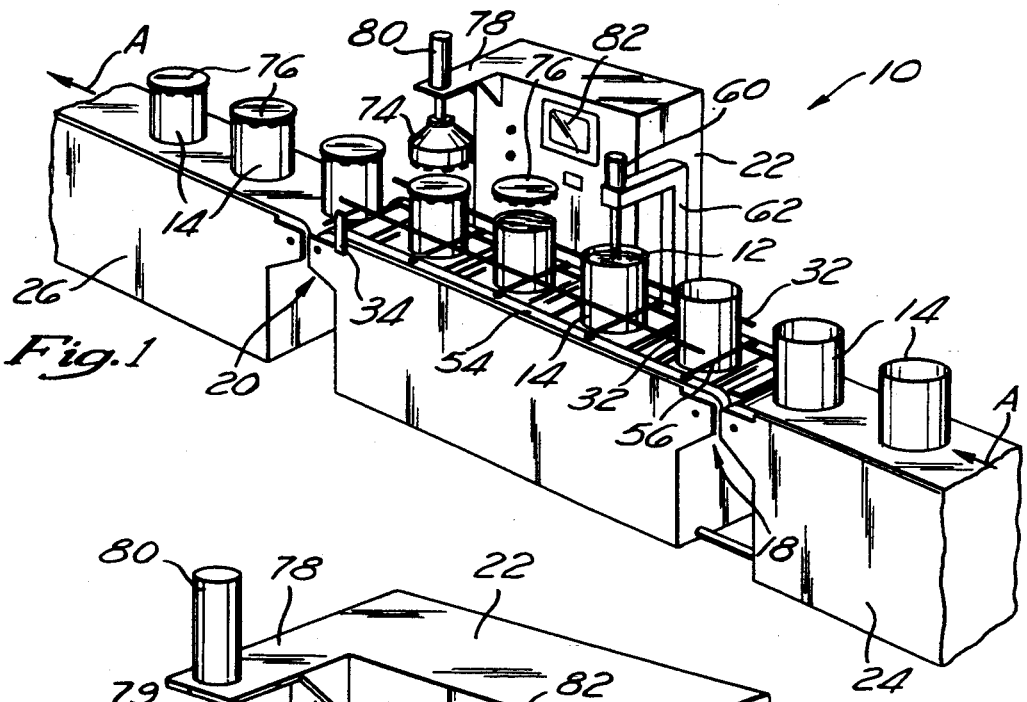
FIG. 1 is a perspective view of the container filler apparatus of the present invention.

Referring now to the drawings wherein the showings are for purposes of illustrating a preferred embodiment of the present invention only, and not for purposes of limiting the same, FIG. 1 perspectively illustrates the container filler apparatus 10 constructed in accordance with the present invention. In the preferred embodiment, the apparatus 10 is utilized to pump a desired volume of paint 12 into cylindrically configured containers 14, though it will be recognized that the apparatus 10 may be used in conjunction with other types of fluids and containers.

Figure 2:
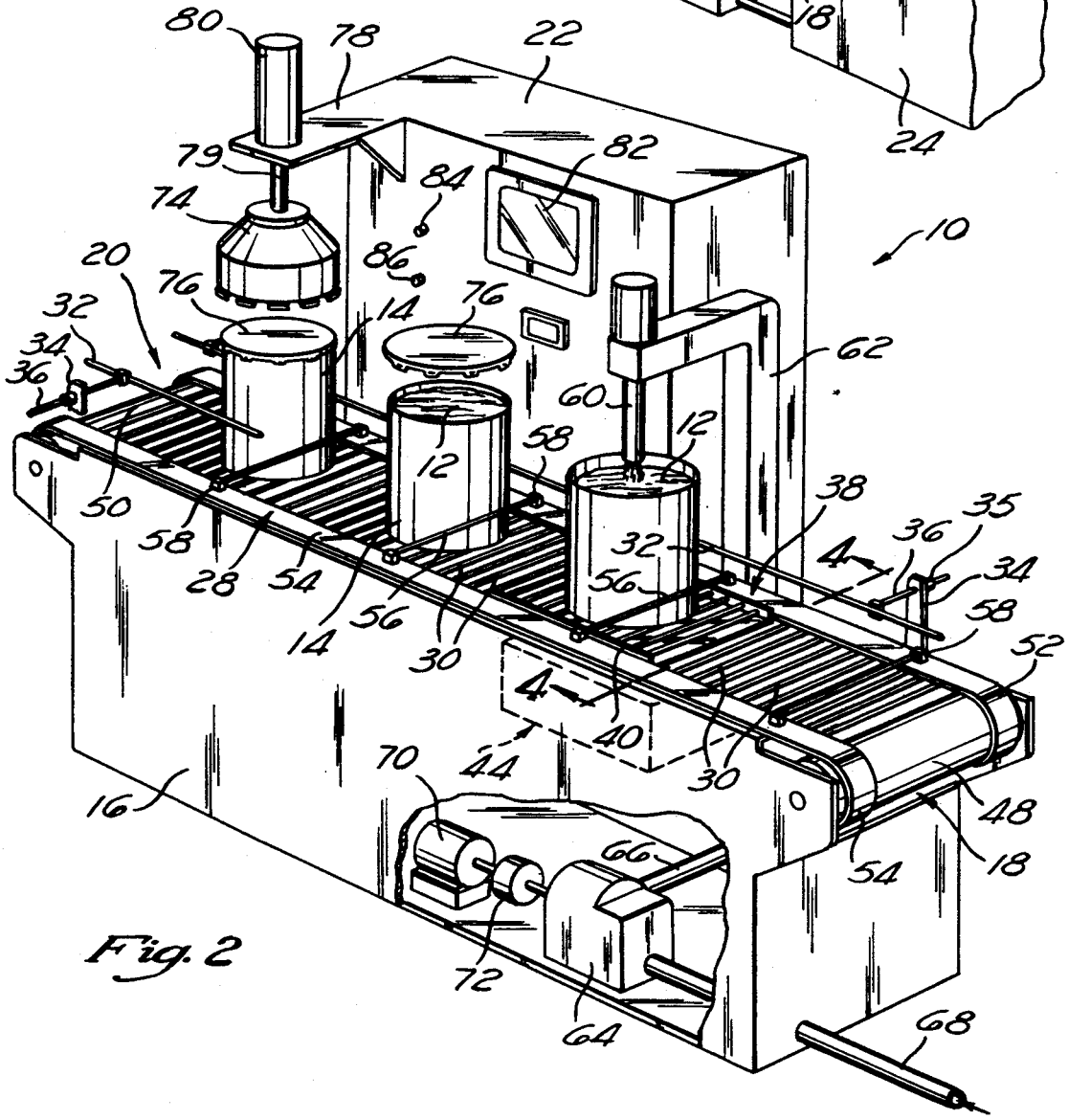
FIG. 2 is an enlarged perspective view of the main section of the apparatus shown in FIG. 1.

Referring now to FIGS. 1 and 2, the apparatus 10 comprises an elongate main housing 16 defining first and second opposed lateral ends 18, 20. Extending upwardly from one of the longitudinal sides of the main housing 16 is a secondary housing 22 which is offset slightly toward the second lateral end 20 of the main housing 16. Disposed adjacent the first and second lateral ends 18, 20 of the main housing 16 are first and second auxiliary conveyor systems 24, 26, the use of which will be discussed below.

Figure 3:
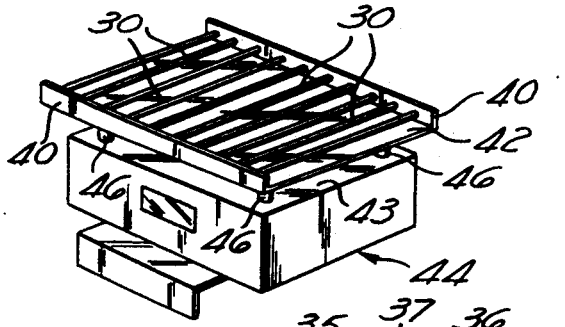
FIG. 3 is a perspective view of the measurement section of the apparatus conveyor.
Figure 4:
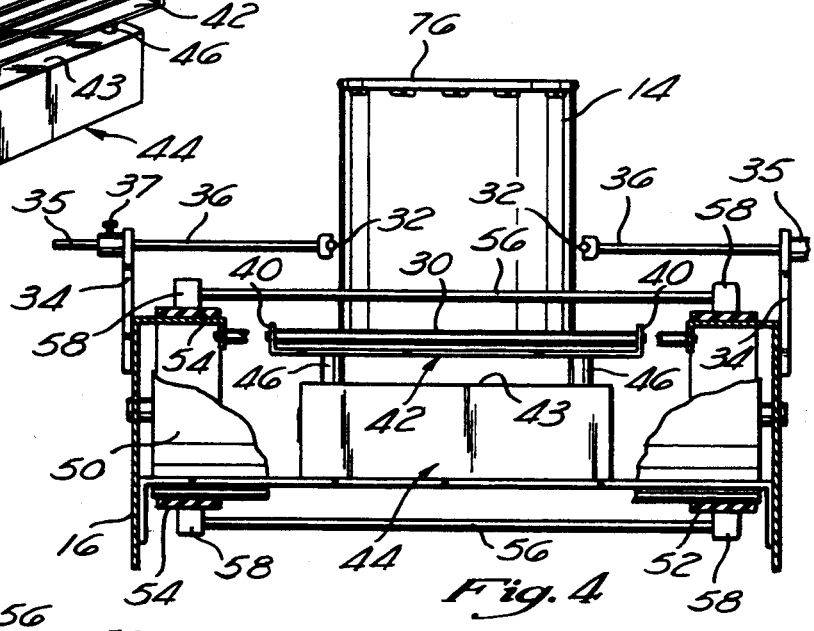
FIG. 4 is a cross-sectional view taken along Line 4—4 of FIG. 2.
Figure 5:
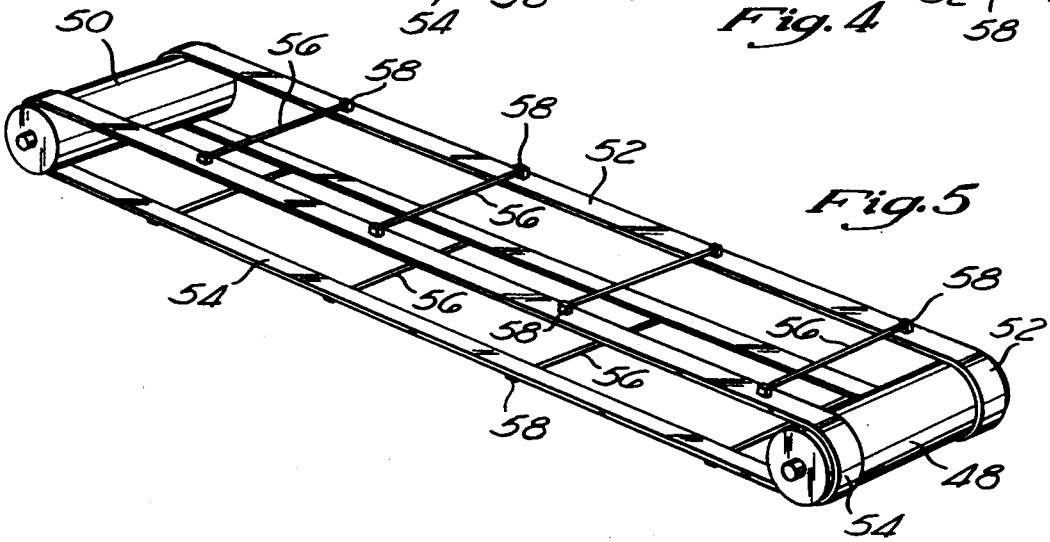
FIG. 5 is a perspective view of the moving means associated with the apparatus conveyor.

Referring now to FIGS. 1–5, the main housing 16 of the apparatus 10 includes a conveyor 28 extending longitudinally along the upper surface thereof. The conveyor 28 comprises a plurality of laterally extending rollers 30 which are disposed in spaced relation. Extending along the opposed longitudinal sides of the conveyor 28 is a pair of elongate guide rails 32, each of which are attached to the main housing 16 via a pair of brackets 34. Advantageously, each of the guide rails 32 is slidably interfaced to its respective pair of brackets 34 via a pair of rods 36 extending perpendicularly therefrom, thus allowing the lateral positions of the guide rails 32 to be selectively adjusted inwardly and outwardly relative the longitudinal sides of the conveyor 28. As seen in FIG. 4, each bracket 34 includes a locking collar 35 attached to the back surface thereof which maintains the rod 36 inserted therethrough in a desired axial position when the set screw 37 of the locking collar 35 is tightened.

As best seen in FIGS. 2–4, the conveyor 28 includes an independent measurement section 38 which is oriented toward the first lateral end 18 of the main housing 16 and comprises a preselected number of rollers 30 which are attached to and extend laterally between a pair of opposed, upwardly extending flanges 40 of a base member 42. As seen in FIG. 3, the base member 42 is itself attached to the planar upper surface 43 of an electronic scale 44 via four posts 46 which are oriented in each of the four corners of the upper surface 43. In the preferred embodiment, the electronic scale 44 is disposed within the main housing 16 in a manner wherein the rollers 30 of the measurement section 38 are continuous with the remaining rollers 30 of the conveyor 28. The use of the measurement section 38 and accompanying electronic scale 44 will be discussed below.

During the use of the apparatus 10, the containers 14 move in the direction designated by the arrow A in FIG. 1 and are transferred from the first auxiliary conveyor system 24 to the conveyor 28, and from the conveyor 28 to the second auxiliary conveyor system 26. To facilitate the movement of the containers 14 along the length of the conveyor 28, the apparatus 10 includes a first roller member 48 rotatably connected to the first lateral end 18 of the main housing 16, and a second roller member 50 rotatably connected to the second lateral end 20 of the main housing 16. In the preferred embodiment, at least one of the roller members 48, 50 is mechanically coupled to a drive means (not shown) disposed within the main housing 16. Extending about the first and second roller members 48, 50 are first and second continuous belt members 52, 54 which extend longitudinally along the opposed sides of the conveyor 28. Extending laterally between the first and second belt members 52, 54 in spaced relation are a plurality of elongate pusher rods 56 which are attached to the belt members 52, 54 via corresponding pairs of mounting blocks 58 attached to the outer surfaces thereof. As best seen in FIG. 2, the pusher rods 56 are spaced from one another a distance substantially exceeding the maximum diameter of any container 14 to be placed upon the conveyor 28. Additionally, as seen in FIGS. 2 and 4, the roller meanders 48, 50 and belt members 52, 54 are oriented relative the conveyor 28 such that each of the pusher rods 56 will engage the lower portion of a respective container 14 during approximately half of its full rotational cycle about the first and second roller members 48, 50. In this respect, when not being used to move a container 14 along the conveyor 28, the pusher rods 56 travel through the interior of the main housing 16. In the preferred embodiment, the containers 14 are moved incrementally along the conveyor 28 by the pusher rods 56, as will be discussed in more detail below.

During a fill cycle, the apparatus 10 is adapted to fill a container 14 with a first volume of the paint at a first flow rate and a second volume of the paint at a second flow rate which is lower than the first flow rate. In the preferred embodiment, the first volume is approximately ninety-five percent (95%) of the total volume of the container 14, with the second volume being approximately five percent (5%) of the total volume of the container 14. To facilitate the filling of each container 14 with the first and second volumes, the apparatus 10 includes a nozzle valve 60 which is used to directly dispense the paint 12 into a container 14. The nozzle valve 60 is selectively actuatable between open and closed positions, and is supported over the approximate center of the measurement section 38 of the conveyor 28 by a valve support member 62 which is attached to and extends upwardly from the main housing 16. As seen in FIG. 2, the nozzle valve 60 is fluidly coupled to a pump 64 via a feed line 66 which extends through the valve support member 62. The pump 64 is itself fluidly coupled to a paint supply source (not shown) via a supply line 68. To drive the pump 64, mechanically coupled thereto is a motor 70. Additionally, connected between the motor 70 and pump 64 is an incremental encoder 72 which is adapted to count the rotations of an impeller (not shown) disposed within the pump 64, for reasons which will be discussed below. The encoder 72 is preferably a digital encoder, though other types of incremental encoders may also be utilized. During a fill cycle, the activation of the motor 70 concurrently with the actuation of the nozzle valve 60 to the open position allows paint to be pumped from the supply source into the container 14 via the supply line 68, pump 64, feed line 66 and nozzle valve 60. As will be recognized, the flow of paint into the container 14 is shut off by the actuation of the nozzle valve 60 to the closed position and the deactivation of the motor 70.

In addition to the nozzle valve 60 which dispenses paint into each container 14, the apparatus 10 includes a lidder 74 which is attached to the secondary housing 22 adjacent the side disposed furthest from the nozzle valve 60 and is used for purposes of sealing a lid member 76 to the upper peripheral rim of a container 14. As seen in FIGS. 1 and 2, the lidder 74 is attached to an extension 78 which is continuous with and extends laterally from the top surface of the secondary housing 22 so as to be centered over an axis longitudinally bisecting the conveyor 28, as is the nozzle valve 60. The lidder 74 is selectively actuatable upwardly and downwardly via a cylinder 80 mechanically coupled thereto by a piston rod 79. During the operation of the apparatus 10, the lid member 76 is manually placed upon the upper rim of the container 14 as the container 14 is incrementally moved from the nozzle valve 60 to the lidder 74 via the conveyor 28 and pusher rods 56.

To control and coordinate the operation of the various components of the apparatus 10, the apparatus 10 includes a controller (not shown) which preferably comprises a microprocessor disposed within the secondary housing 22. Disposed within the front surface of the secondary housing 22 is a CRT 82 which allows the operator to program the controller via touch screen input, and also provides certain visual readouts corresponding to the operation of the apparatus 10. Also disposed on the front surface of the secondary housing 22 are an EMERGENCY STOP button 84 and a RUN button 86. In the preferred embodiment, the conveyor drive means, electronic scale 44, nozzle valve 60, motor 70, incremental encoder 72 and cylinder 80 are each electrically interfaced to the controller.

APPARATUS OPERATIONAL CYCLE

In the preferred embodiment, the apparatus 10 constructed in accordance with the present invention is typically used to fill containers 14 having internal volumes of one gallon and five gallons. As previously indicated, the container 14 is preferably initially filled with a first volume, i.e. ninety-five percent (95%) of the internal volume, at a first, high-speed flow rate, and subsequently filled with a second volume, i.e. the remaining five percent (5%) of the internal volume, at a second flow rate which is substantially lower than the first flow rate. However, it will be recognized that the levels to which the container 14 is filled during the first and second filling operations may be varied, and that the ninety-five percent/five percent (95%–5%) ratios previously specified constitutes only one possible proportion.

During the operation of the apparatus 10, each container 14 is initially transferred from the first auxiliary conveyor system 24 onto the conveyor 28. As previously specified, the roller members 48, 50 and hence the belt members 52, 54 and pusher rods 56 are not constantly moving, but rather are moved incrementally by the selective activation of the drive means by the controller. As such, a single incremental movement of the pusher rods 56 simultaneously causes a first container 14 to be transferred from the first auxiliary conveyor system 24 to a first portion of the conveyor 28 disposed between the first roller member 48 and measurement section 38; a second container 14 to be transferred from the first portion of the conveyor 28 to a position which is approximately in the center of the measurement section 38; a third container 14 to be transferred from the center of the measurement section 38 to a second portion of the conveyor 28 disposed between the nozzle valve 60 and lidder 74; a fourth container 14 to be transferred from the second portion of the conveyor 28 to a position on the conveyor 28 directly underneath the lidder 74; and a fifth container 14 to be transferred from underneath the lidder 74 to the second auxiliary conveyor system 26. Advantageously, the controller is operable to cause a slight reverse rotation of the roller members 48, 50 after each incremental movement of the pusher rods 56, thus causing each of the pusher rods 56 to back away out of abutting contact with the lower portion of a respective container 14 immediately after the completion of each incremental movement, for reasons which will be discussed below.

After a container 14 has been positioned upon the measurement section 38, and the associated pusher rod 56 has been backed away therefrom, the controller takes a first measurement of the tare weight, i.e. empty weight, of the container 14 via the electronic scale 44. In this respect, since the base member 42 and its associated roller members 30 are separately interfaced to the scale 44 via the posts 46, a weight measurement is generated by the scale 44 which is compensated for the weight associated with the posts 46, base member 42 and rollers 30, thus resulting in a highly accurate first tare weight measurement. The first measurement of the container tare weight is then stored in a memory means such as a memory chip electrically interfaced to the controller. The controller then calculates a target fill weight by adding the stored tare weight measurement to a predetermined value previously input into the controller and stored in the memory means corresponding to the weight of the paint needed to be dispensed into the container 14 to totally fill the same.

After the target fill weight has been calculated, the controller activates the motor 70 and hence the pump 64, and actuates the nozzle valve 60 to the open position thus allowing the paint to be pumped from the supply source into the container 14 at the first flow rate. In the preferred embodiment, the first flow rate is programed into the controller, with the controller being operable to control the first flow rate by maintaining the motor speed and hence the pump impeller rotational speed at a first level. As the paint is being pumped into the container 14, the incremental encoder 72 electrically interfaced to the controller counts and continuously inputs to the controller the number of rotations of the pump impeller. In this respect, the controller is also programmed with a preselected number of impeller rotations corresponding to the number of impeller rotations believed to be needed to obtain a first fill volume at the first flow rate wherein the weight of the container 14 after being filled with the first volume is approximately ninety-five percent (95%) of the target fill weight. As such, when the encoder 72 generates an electrical signal corresponding to the preselected number of impeller rotations needed to establish that the container has been filled with the first volume of paint, the controller deactivates the motor 70 and hence the pump 64 and actuates the nozzle valve 60 to the closed position.

Subsequent to the actuation of the nozzle valve 60 to the closed position, a weight measurement of the container 14 as filled with the first volume is generated by the scale 44 to the controller. The controller then compares this weight measurement to a weight value preprogrammed thereinto corresponding to the expected weight of a container filled to 95 percent of its capacity, and determines whether the weight measurement falls within an acceptable range of the expected weight value. If the controller determines that the volume of paint dispensed into the container 14 as calculated by the weight measurement is substantially above or below the desired 95 percent level, the controller will cause the volume of paint dispensed into the container 14 during the second volume filling operation to be increased or decreased as needed.

After the container 14 has been filled with the first volume of paint in the aforementioned manner, the controller activates the motor 70 and actuates the nozzle valve to the open position, thus allowing the paint to be pumped into the container 14 at the second flow rate which is substantially lower than the first flow rate. Like the first flow rate, the second flow rate is also programmed into the controller, with the controller being operable to control the second flow rate by maintaining the motor speed and hence the pump impeller rotational speed at a second level lower than the first level. As the container 14 is being filled with the second volume of paint at the second flow rate, measurements of the total weight of the container 14 are continuously generated to the controller by the electronic scale 44 in the form of dampened sine wave input. As the sine wave input is generated by the scale 44 to the controller, the controller conducts an extrapolation process and projects an amount of time the nozzle valve 60 will have to remain in the open position to obtain a total weight measurement of the container 14 which falls within an acceptable range corresponding to the target fill weight. When the projected time has elapsed thus establishing that the container 14 has been filled with the second volume, the controller deactivates the motor 70 and hence the pump 64, and actuates the nozzle valve 60 to the closed position. Importantly, the pusher rods 56 are backed away out of abutting contact with the lower portions of their respective container 14 so as not to adversely affect any of the tare weight or total weight measurements taken by the scale 44.

Since changes in temperature have a direct effect on the previously described first and second volume filling operations, the controller is adapted to maintain the desired accuracy levels in the volume/weight of the paint dispensed into the container 14 by analyzing these measurements in relation to changes in temperature. In this respect, the controller uses a regression-to-means analysis to calculate correction factors for the first and second volume filling operations when a temperature change causes the volume/weight measurements conducted during the first and second volume filling operations to drift from desired values within the acceptable range. Particularly, when a volume/weight measurement is generated during the first and/or second volume-filling operations which is within an acceptable range but is recognized to be drifting from the optimal desired value within the range due to changes in temperature, the correction factors calculated by the controller facilitate increases or decreases in the volume/- weight of paint dispensed during subsequent cycles of the apparatus 10, thus compensating for the temperature variations.

After the container 14 has been filled with the first and second volumes of paint at the first and second flow rates in the aforementioned manner, the container 14 is transferred to the second portion of the conveyor 28 intermediate the nozzle valve 60 and lidder 74 as previously described. Importantly, the entire fill cycle associated with filling a container 14 with the first and second volumes of paint at the first and second flow rates is less than ten seconds. As such, the drive means is activated by the controller to facilitate an incremental movement of the pusher rods 56 approximately every 10 seconds. After the lid member is manually placed upon the container 14 when such is positioned on the second portion of the conveyor 28, the container 14 is transferred to the position underneath and in axial alignment with the lidder 74. Thereafter, the controller actuates the cylinder 80, thus causing the lidder 74 to actuate downwardly and seal the lid member 76 upon the upper rim of the container 14. After the lid member 76 is sealed thereon, the container 14 is transferred from the conveyor 28 onto the second auxiliary conveyor system 26. As will be recognized, the lateral positioning of the guide rails 32 may be selectively adjusted so as to accommodate one or five gallon paint containers and properly align such containers under the nozzle valve 60 and lidder 74.

CALIBRATION PROCEDURES

During the programming of the controller 10, the first and second volume filling operations are preferably calibrated to ensure an accuracy level in the total weight of the paint dispensed into the container 14 of +/− one gram. In the preferred embodiment, the calibration of the first and second volume filling operations is a two-stage process. In the initial stage, the operator first inputs into the controller a predetermined value corresponding to the weight of the paint needed to be dispensed into the container 14 to totally fill the same. An empty container 14 is then positioned upon the measurement section 38, with the tare weight of the container 14 being measured by the scale 44 and stored in the memory means. The controller 10 then adds the tare weight measurement to the previously input total paint weight value to obtain a target fill weight which is also stored in the memory means. Thereafter, the controller is caused to dispense a first preselected volume of paint into the container 14 at a first flow rate. In the preferred embodiment, the container 14 is filled with the first preselected volume when the weight thereof as measured by the scale 44 and generated to the controller is approximately eighty percent of the calculated target fill weight. As such, when the weight of the container 14 reaches approximately eighty percent of the target fill weight, the first volume filling operation is terminated by the controller. After the first preselected volume of paint has been pumped into the container 14, a first total weight measurement of the container 14 is generated to the controller by the scale 44.

Using the first total weight measurement as a guideline, the controller calculates the ratio of the number of impeller rotations of the pump 64 which occurred during the first preselected volume filling operation to the first total weight measurement. The controller then calculates the number of impeller rotations of the pump 64 needed to dispense a second preselected volume of paint into the container 14 at a second flow rate which is lower than the first flow rate. In the preferred embodiment, the container 14 is filled with the second preselected volume when the weight thereof as measured by the scale 44 and generated to the controller is increased by approximately 15 percent, i.e. reaches approximately 95 percent of the target fill weight. If the controller makes a determination that the ratio of impeller rotations to the first total weight measurement is within an acceptable range, the controller causes the second preselected volume of paint to be dispensed into the container 14 at the second flow rate. When the weight of the container 14 reaches approximately 95 percent of the target fill weight, the second volume filling operation is terminated by the controller. Subsequent to the completion of the second volume filling operation, a second total weight measurement of the container 14 is generated to the controller by the scale 44.

After receiving and storing the second total weight measurement, the controller is caused to dispense a third preselected volume of paint into the container 14 at a third flow rate which is lower than the second flow rate. In the preferred embodiment, the container 14 is filled with the third preselected volume when the weight thereof as measured by the scale 44 and generated to the controller falls within an acceptable range corresponding to the target fill weight. As the third preselected volume is being dispensed into the container 14, total weight measurements of the container 14 are continuously generated to the controller by the scale 44. When the weight of the container 14 reaches the target fill weight, the controller terminates the third volume filling operation. Thereafter, the controller calculates certain calibration data by determining the amount of time the nozzle valve 60 remains open during the third preselected volume filling operation to achieve the target fill weight.

In the second stage of the calibration process, a second container 14 is positioned upon the measurement section 38, with the tare weight of the container 14 being measured by the scale 44 and stored in the memory means. The controller then adds the total paint weight value previously input thereinto to the new tare weight measurement to obtain a new target fill weight which is also stored in the memory means. Thereafter, the controller is caused to dispense a new first preselected volume of paint into the container 14 at the first flow rate. In the second calibration stage, the container 14 is filled with the new first preselected volume when the weight thereof as measured by the scale 44 and generated to the controller is approximately 98 percent of the new target fill weight. As such, the dispensation of the new first preselected volume of paint into the container 14 is terminated by the controller when the weight of the container 14 reaches approximately 98 percent of the new target fill weight.

After the new first preselected volume filling operation is completed, a new first total weight measurement of the container 14 is generated to the controller by the scale 44. Using this new first total weight measurement as a guideline, the controller calculates the ratio of the number of impeller rotations of the pump 64 which occurred during the dispensation of the new first preselected volume into the container 14 to the new first total weight measurement. This particular ratio is stored in the memory means to be used as a base setting for the required number of impeller rotations needed to conduct the first volume filling operation during the automatic operation of the apparatus 10. Thereafter, the controller is caused to dispense a new second preselected volume of paint into the container 14 at the third flow rate. In the second calibration stage, the container 14 is filled with the new second preselected volume when the weight thereof as measured by the scale 44 and generated to the controller falls within an acceptable range corresponding to the new target fill weight. As such, the dispensation of the new second preselected volume into the container 14 is terminated when the weight of the container 14 reaches the new target fill weight. The controller then calculates the amount of time the nozzle valve 60 remains open during the new second preselected volume filling operation to reach the new target fill weight and stores associated parameters in the memory means for use as a base setting for the amount of time the nozzle valve 60 must remain open to conduct the second volume filling operation during the automatic operation of the apparatus 10.

During the first and second volume filling operations, the controller causes the nozzle valve 60 to actuate to the closed position approximately ten to fifteen milliseconds prior to the shutoff of the motor 70. As will be recognized, due to the calibration of the first and second volume filling operations, the use of the encoder 72 to count impeller rotations, and the use of the electronic scale 44 to measure the total container weight as the second volume is being dispensed into the container 14, extremely high levels of accuracy are achieved with the apparatus 10 in relation to the total volume of paint dispensed into the container 14.

Additional modifications and improvements of the present invention may also be apparent to those skilled in the art. Thus, the particular combination of parts described and illustrated herein is intended to represent only one embodiment of the invention, and is not intended to serve as limitations of alternative devices within the spirit and scope of the invention.

What is claimed is:

1. An apparatus for filling a container with a fluid, comprising:

means for filling said container with a first volume of said fluid at a first flow rate;

means for filling said container with a second volume of fluid at a second flow rate lower than said first flow rate; and means for controlling and coordinating the operation of said first volume filling means and said second volume filling means;

said first and second volume filling means each comprising:

a fluid supply source;

a pump having a rotatable impeller therein, said pump being fluidly coupled to said supply source and electrically interfaced to said control means; and a nozzle valve fluidly coupled to said pump and electrically interfaced to said control means, said container being positioned under said nozzle valve;

said first volume filling means further comprising:

an incremental encoder electrically interfaced to said pump and said control means, said encoder being operable to count the rotations of the pump impeller;

said control means being operable to sequentially activate the pump and open the nozzle valve to allow the fluid to be pumped from the supply source into the container at said first flow rate, and deactivate said pump and close said nozzle valve in response to an electrical signal generated by said encoder corresponding to a preselected number of impeller rotations programed into the control means needed to establish that the container has been filled with the first volume.

2. The apparatus of claim 1 wherein said first volume is approximately ninety-five percent (95%) of the total volume of the container and said second volume is approximately five percent (5%) of the total volume of the container.

3. The apparatus of claim 1 wherein said second volume filling means further comprises:

a scale electrically interfaced to said control means, said container being disposed upon said scale;

said control means being operable to sequentially take a first measurement of the container weight via the scale prior to filling the container with the first volume of fluid, calculate a target fill weight by adding the first weight measurement to a predetermined value programmed in the control means corresponding to the weight of the fluid needed to be dispensed into the container to completely fill the container, store the target fill weight, activate the pump and open the nozzle valve to allow the fluid to be pumped into the container at the second flow rate after the container is filled with the first volume, take total weight measurements of the container as the container is being filled with the second volume, project an amount of time the nozzle valve must remain open to obtain a total weight measurement substantially equal to the target fill weight and deactivate the pump and close the nozzle valve when the projected amount of time elapses, thus establishing that the container has been filled with the second volume.

4. The apparatus of claim 3 further comprising:

a conveyor, said container being positionable on said conveyor;

means for sealing a lid member to the container; and means for incrementally moving said container along said conveyor, said moving means being operable to transport said container from said first and second volume filling means to said lid member sealing means;

said conveyor including a measurement section interfaced to said scale in a manner wherein said scale is able to take weight measurements of said container when said container is positioned on said measurement section by said moving means.

5. The apparatus of claim 4 wherein said moving means comprises:

first and second roller members disposed at opposed ends of said conveyor, at least one of said roller members being mechanically coupled to a drive means electrically interfaced to said control means;

first and second continuous belt members extending about said first and second roller members in a manner wherein said first and second belt members extend longitudinally along opposed sides of the conveyor; and a plurality of elongate pusher rods attached to and extending laterally between said first and second belt members in spaced relation;

said container being incrementally movable along said conveyor by any one of said pusher rods, and said control means being operable to cause said pusher rods to back away out of abutting contact with said container when said container is positioned upon said measurement section and under said nozzle valve thereby.

6. The apparatus of claim 3 wherein said first and second volume filling means each further comprise a motor mechanically coupled to said pump and electrically interfaced to the control means, said encoder being connected between said motor and said pump.

7. An apparatus for filling a container with a fluid, comprising:

means for filling said container with a first volume of said fluid at a first flow rate;

means for filling said container with a second volume of said fluid at a second flow rate lower than said first flow rate; and means for controlling and coordinating the operation of said first volume filling means and said second volume filling means;

said container being filled with the first and second volumes of fluid while being maintained in one position on said apparatus.

8. A method for filling a container with a fluid comprising the steps of:

positioning the container upon a scale;

measuring the tare weight of the container via the scale;

calculating a target fill weight;

storing the target fill weight in a memory means;

filling the container with a first volume of fluid at a first flow rate while said container is positioned upon said scale; and filling the container with a second volume of fluid at a second flow rate lower than the first flow rate while said container is positioned upon said scale.

9. A method for filling a container with a fluid comprising the steps of:

positioning the container upon a scale;

measuring the tare weight of the container via the scale;

calculating a target fill weight;

storing the target fill weight in a memory means;

filling the container with a first volume of fluid at a first flow rate; and filling the container with a second volume of fluid at a second flow rate lower than the first flow rate;

the step of filling the container with the first volume of fluid comprising the steps of:

positioning the container under a nozzle valve;

activating a pump fluidly Coupled to the nozzle valve;

opening the nozzle valve to allow the fluid to be pumped from a fluid supply source coupled to the pump into the container at the first flow rate;

counting the number of rotations of an impeller disposed within the pump via an incremental encoder electrically interfaced to the pump;

deactivating the Rump in response to an electrical signal generated by the encoder establishing that the container has been filled with the first volume based on a preselected number of impeller rotations counted by the encoder; and closing the nozzle valve.

10. The method of claim 9 further comprising the step of sealing a lid member to the container after the container is filled with the second volume.

11. The method of claim 9 wherein the step of filling the container with the second volume of fluid comprises the steps of:

activating the pump;

opening the nozzle valve to allow the fluid to be pumped from the supply source into the container at the second flow rate after the container is filled with the first volume;

taking measurements of the total weight of the container via the scale as the container is being filled with the second volume of fluid;

projecting the amount of time the nozzle valve must remain open to obtain a total weight measurement substantially equal to the target fill weight;

deactivating the pump when the projected amount of time elapses thus establishing that the container has been filled with the second volume of fluid; and closing the nozzle valve.

12. The method of claim 11 further comprising a first calibration stage, comprising the steps of:

positioning a container upon the scale;

measuring the tare weight of the container via the scale;

calculating a target fill weight by adding the tare weight measurement to a predetermined value programmed into the control means corresponding to the weight of the fluid needed to be dispensed into the container to completely fill the container;

storing the target fill weight;

filling the container with a first preselected volume of fluid at a first flow rate;

taking a first total weight measurement of the container;

calculating the ratio of the number of impeller rotations which occurred during the first preselected volume filling operation to the first total weight measurement;

calculating the number of impeller rotations needed to dispense a second preselected volume of paint into the container at a second flow rate lower than the first flow rate;

filling the container with the second preselected volume of fluid at the second flow rate;

filling the container with a third preselected volume of fluid at a third flow rate lower than the second flow rate; and calculating the amount of time the nozzle valve remains open during the third preselected volume filling operation to achieve the target fill weight.

13. The method of claim 11 wherein the step of calculating the target fill weight further comprises the step of adding the first weight measurement to a predetermined value programed into the control means corresponding to the weight of the fluid needed to be dispensed into the container to completely fill the container.

14. The method of claim 12 further comprising a second calibration stage, comprising the steps of:

positioning a second container upon the scale;

measuring the tare weight of the second container via the scale;

calculating a new target fill weight by adding the tare weight of the second container to the total paint weight value input into the control means;

storing the new target fill weight in the memory means;

filling the container with a new first preselected volume of fluid at the first flow rate;

taking a new first total weight measurement of the container;

calculating the ratio of the number of impeller rotations which occurred during the new first preselected volume filling operation to the new first total weight measurement;

storing the ratio in the memory means;

filling the container with a new second preselected volume of fluid at the third flow rate;

calculating the amount of time the nozzle valve remains open during the new second preselected volume filling operation to achieve the new target fill weight; and storing the time measurement in the memory means.

* * * * *